US009091960B2

(12) United States Patent
Handa et al.

(10) Patent No.: US 9,091,960 B2
(45) Date of Patent: Jul. 28, 2015

(54) DEVELOPING DEVICE FOR PREVENTING TONER LEAKAGE

(71) Applicants: Hiroshi Handa, Inazawa (JP); Hiroki Mori, Nagoya (JP)

(72) Inventors: Hiroshi Handa, Inazawa (JP); Hiroki Mori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/091,362

(22) Filed: Nov. 27, 2013

(65) Prior Publication Data

US 2014/0153960 A1 Jun. 5, 2014

(30) Foreign Application Priority Data

Nov. 30, 2012 (JP) ..... 2012-263425

(51) Int. Cl.
*G03G 15/08* (2006.01)

(52) U.S. Cl.
CPC ..... *G03G 15/0817* (2013.01)

(58) Field of Classification Search
CPC ..... G03G 15/0817; G03G 15/0898
USPC ..... 399/103, 105
See application file for complete search history.

(56) References Cited

U.S. PATENT DOCUMENTS 5,552,868 A 9/1996 Iwama et al.
6,907,207 B2 6/2005 Shoji et al.
7,333,746 B2 * 2/2008 Nagata et al. ..... 399/103
7,623,815 B2 11/2009 Mori et al.
2003/0118364 A1 * 6/2003 Kamimura ..... 399/103
2007/0242973 A1 * 10/2007 Yaji ..... 399/103
2009/0317144 A1 12/2009 Koido
2010/0150603 A1 * 6/2010 Sakamoto et al. ..... 399/103
2011/0064454 A1 3/2011 Xu et al.
2011/0236057 A1 9/2011 Nakajima et al.
2013/0051840 A1 * 2/2013 Yamamoto et al. ..... 399/103 X

FOREIGN PATENT DOCUMENTS

JP 2006-201591 A 8/2006
JP 2011-203298 A 10/2011

OTHER PUBLICATIONS

Co Pending U.S. Appl. No. 14/091,361, filed Nov. 27, 2013.
Nov. 17, 2014—(US) Non-Final Office Action—U.S. Appl. No. 14/091,361.
May 22, 2015—(US) Final Office Action—U.S. Appl. No. 14/091,361.

* cited by examiner

*Primary Examiner* — Sophia S Chen
(74) *Attorney, Agent, or Firm* — Banner & Witcoff, Ltd.

(57) ABSTRACT

A cartridge is configured to supply developing agent to a peripheral surface of a photosensitive drum. The cartridge includes a frame, a developing roller and first and second side seal members. The developing roller defines an axial direction, and is configured to supply developing agent in the frame to the photosensitive drum. The first side seal member is configured to seal a boundary between the frame and one end portion of the developing roller in the axial direction. The second side seal member is configured to seal a boundary between the frame and another end portion of the developing roller. The first and second side seal members define a gap therebetween in the axial direction, and the gap has a gap length smaller than a width in the axial direction of a maximum width sheet conveyed to the photosensitive drum.

8 Claims, 7 Drawing Sheets

DEVELOPING DEVICE FOR PREVENTING TONER LEAKAGE

CROSS REFERENCE TO RELATED APPLICATION

This application claims priority from Japanese Patent Application No. 2012-263425 filed Nov. 30, 2012, the entire content of which is incorporated herein by reference.

TECHNICAL FIELD

The present invention relates to a cartridge configured to supply developing agent to a peripheral surface of a photosensitive drum in an image forming device.

BACKGROUND

Japanese Patent Application Publication No. 2006-201591 discloses a process unit as an example of the cartridge. The process unit includes a supply roller, a developing roller, a photosensitive drum, and a seal unit. The supply roller is rotatable about its axis and is configured to carry toner as developing agent on its outer peripheral surface. The developing roller is rotatable and in frictional contact with the peripheral surface of the supply roller. The photosensitive drum is rotatable and is in contact with a peripheral surface of the developing roller. The seal unit includes a right and left seal members each in frictional contact with each axial end portion of the developing roller for avoiding toner leakage therefrom. A gap between the right and left seal members is greater than a width of a maximum width sheet conveyed by the photosensitive drum.

SUMMARY

According to the cartridge disclosed in the JP publication, paper dust deposited on the sheet is deposited on the peripheral surface of the photosensitive drum, and the paper dust may be transferred onto the peripheral surface of the developing roller from the peripheral surface of the photosensitive drum. The paper dust may be entered into a toner cartridge and mixed with the toner.

Due to mixing the paper dust with the toner, electrical charge amount of the toner may be lowered during triboelectric charging between the supply roller and the developing roller. As a result, a uniform thickness of the toner layer may not be formed on the peripheral surface of the developing roller.

In view of the foregoing, it is an object of the invention to provide a cartridge capable of restraining paper dust that has been deposited on the sheet conveyed by the photosensitive drum from being mixed into developing agent.

In order to attain the above and other objects, the invention provides a cartridge for supplying developing agent to a peripheral surface of a photosensitive drum. The cartridge includes a frame, a developing roller, a first side seal member, and a second side seal member. The frame is configured to accommodate therein developing agent. The developing roller is rotatable about an axis that defines an axial direction, and is configured to supply the developing agent in the frame to the photosensitive drum. The developing roller has one end portion and another end portion in the axial direction. The first side seal member is configured to seal a boundary between the frame and the one end portion of the developing roller. The second side seal member is configured to seal a boundary between the frame and another end portion of the developing roller. The first side seal member and the second side seal member define a gap therebetween in the axial direction. The gap has a gap length smaller than a width in the axial direction of a maximum width sheet conveyed to the photosensitive drum.

DETAILED DESCRIPTION

Figure 1:
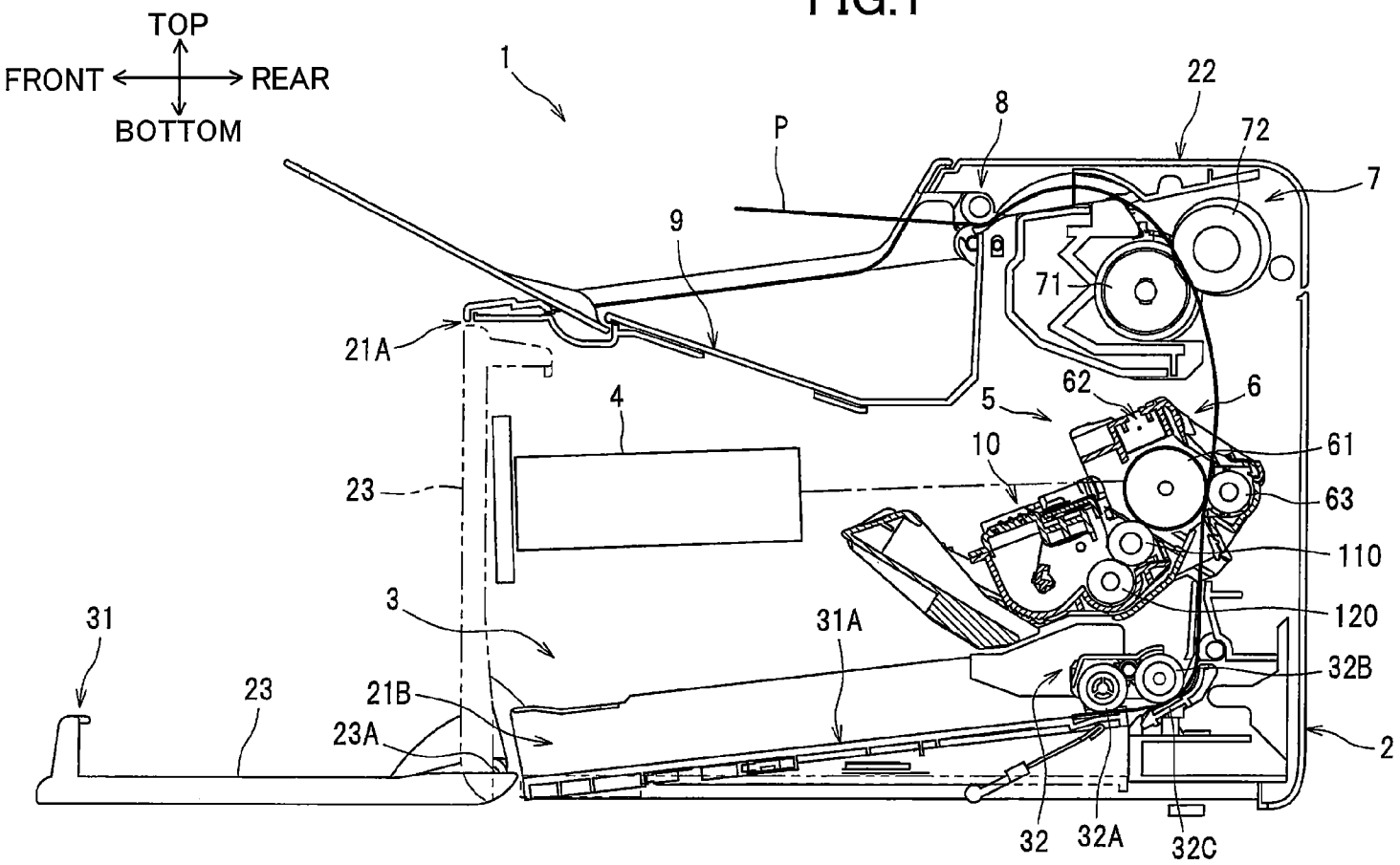
FIG. 1 is a schematic cross-sectional side view of a laser printer provided with a process cartridge according to one embodiment of the present invention.

A cartridge according to one embodiment of the present invention will be described with reference to FIGS. 1 through 7. The cartridge according to the embodiment constitutes a process cartridge 5 used in a laser printer 1 shown in FIG. 1. The terms "upward", "downward", "upper", "lower", "above", "below", "beneath", "right", "left", "front", "rear" and the like will be used throughout the description assuming that the laser printer 1 is disposed in an orientation in which it is intended to be used. In use, the laser printer 1 is disposed as shown in FIG. 1 in which left side and right of FIG. 1 will be referred to as a "front side" and a "rear side" respectively. Further, a direction perpendicular to frontward/rearward direction will be referred to as "lateral direction" or "leftward/rightward direction", and a direction perpendicular to the frontward/rearward direction and to the lateral direction will be referred to as "vertical direction".

[Overall Structure of the Laser Printer]

As shown in FIG. 1, the laser printer 1 includes a main casing 2, a feeder unit 3, a scanner unit 4, a process cartridge 5 configured to form a toner image on a sheet P, and a fixing unit 7 for thermally fixing the toner image to the sheet P.

The main casing 2 includes a top cover 22 and a front cover 23, and has a front end formed with an opening 21A for attachment and detachment of the process cartridge 5. Further, a sheet insertion portion 21B is provided at a lower portion of the opening 21A for inserting a sheet P.

The front cover 23 is pivotally movably supported to a lower front end portion of the main casing 2 by a pivot shaft 23A, such that the front cover 23 is movable to an upstanding position closing the opening 21A as indicated by two dotted chain line and to a lying position opening the opening 21A as indicated by a solid line.

The feeder unit 3 is positioned at a lower interior space of the main casing 2, and includes a sheet supply tray 31 for accommodating a stack of sheets P, and a sheet supply mechanism 32 configured to supply the sheet in the sheet supply tray 31. The sheet supply tray 31 is constituted by a sheet stand 31A positioned at the lower portion of the main casing 2 and the front cover 23 opened in continuous manner with the sheet stand 31A.

The sheet supply mechanism 32 includes a sheet supply roller 32A, a separation roller 32B, and a separation pad 32C. The sheet supply roller 32A is positioned upward of a rear end portion of the sheet stand 31A. The separation roller 32B is positioned downstream of the sheet supply roller 32A in a sheet feeding direction. The separation pad 32C is positioned in confrontation with the separation roller 32B such that the sheet P is nipped therebetween.

In the feeder unit 3, the sheet P mounted on the upper surface of the lying front cover 23 and on the sheet stand 31A is supplied toward the separation roller 32B by the rotation of the sheet supply roller 32A. Then, an uppermost sheet P is separated from the remaining sheets of the sheet stack by the separation roller 32B and the separation pad 32C, and is supplied toward the process cartridge 5.

The scanner unit 4 is positioned at a front side of the inner space of the main casing 2, and includes a laser emitting portion, a polygon mirror, a lens and a reflection mirror those not shown. The scanner unit 4 is configured to emit laser beam to an outer peripheral surface of a photosensitive drum 61 (described later) with high speed scanning.

Figure 2:
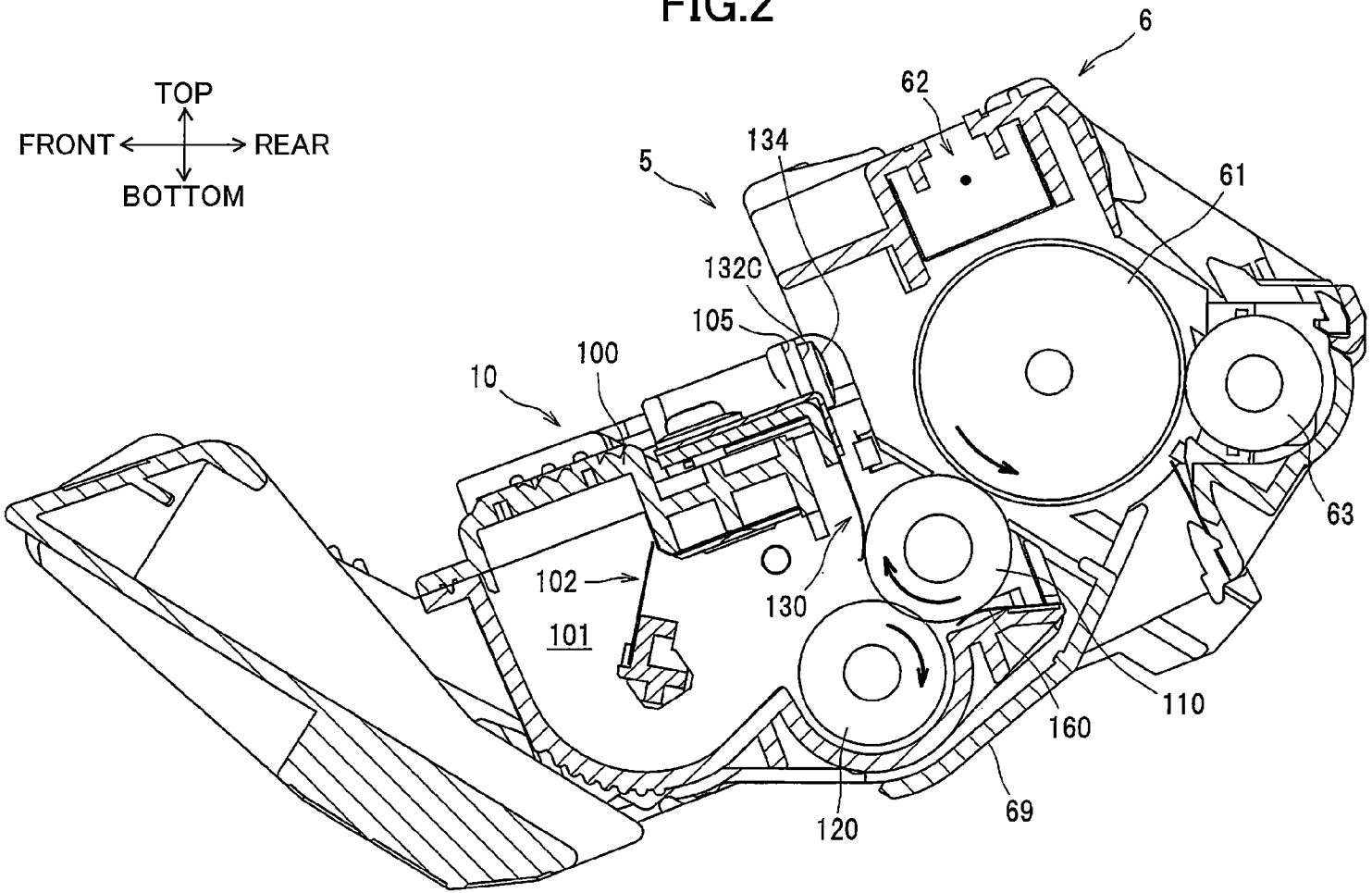
FIG. 2 is an enlarged cross-sectional view of the process cartridge including a developing cartridge according to the embodiment.

The process cartridge 5 is positioned above the sheet supply mechanism 32 at a rear side of and a widthwise center of the internal space of the main casing 2. The process cartridge 5 can be detached from and attached to the main casing 2 through the opening 21A. As shown in FIG. 2, the process cartridge 5 includes a drum unit 6 and a developing cartridge 10 as a cartridge.

The drum unit 6 includes a drum frame 69, the photosensitive drum 61, a charger 62 and a transfer roller 63 those provided in the drum frame 69. The developing cartridge 10 is detachably attachable to the drum unit 6, and includes a frame 100, a developing roller 110, a supply roller 120, and a blade unit 130 for regulating a thickness of a layer of developing agent.

The developing roller 110 is configured to carry developing agent (toner) on its peripheral surface. The developing roller 110 is rotatable about its axis and is supported to the frame 100. The supply roller 120 is configured to supply toner carried on its peripheral surface to the peripheral surface of the developing roller 110. The supply roller 120 is positioned diagonally frontward and downward of the developing roller 110 in an accommodated state of the process cartridge 5 to the main casing 2. The supply roller 120 extends in a direction parallel to an axial direction of the developing roller 110.

The frame 100 defines a toner chamber 101 in which an agitator 102 is rotatably provided for agitating toners accommodated in the toner chamber 101. After the toner in the toner chamber 101 is subjected to agitation by the agitator 102, the toner is supplied from the peripheral surface of the supply roller 120 to the peripheral surface of the developing roller 110. In this case, the toner is tribocharged with positive polarity between the peripheral surfaces of the supply roller 120 and the developing roller 110. Then, the toner carried on the peripheral surface of the developing roller 110 is entered into a space between the blade unit 130 and the peripheral surface of the developing roller 110 while being subjected to triboelectric charging in accordance with the rotation of the developing roller 110. Thus, the toner layer having a uniform thickness is carried on the peripheral surface of the developing roller 110.

In the drum unit 6, after the peripheral surface of the rotating photosensitive drum 61 is uniformly charged by the charger 62, the surface of the photosensitive drum 61 is exposed to laser beam with high speed scanning by the scanner unit 4. Thus, electric potential of the exposed region of the photosensitive drum 61 is lowered to provide an electrostatic latent image based on image data on the peripheral surface of the photosensitive drum 61.

Accordingly, toner image corresponding to the electrostatic latent image is formed on the peripheral surface of the photosensitive drum 61 by supplying toner from the developing roller 110. Thereafter, the toner image on the photosensitive drum 61 is transferred onto the sheet P when the sheet P passes through a gap between the photosensitive drum 61 and the transfer roller 63 to which a transfer bias is applied.

The fixing unit 7 is positioned at an upper rear portion of the internal space of the main casing 2 and above the process cartridge 5, and includes a heat roller 71 and a pressure roller 72. The heat roller 71 is adapted to heat the sheet P, and has an internal space provided with a heat source such as a halogen lamp (not shown). The pressure roller 72 is positioned diagonally rearward and above the heat roller 71 and adapted to nip the sheet P in cooperation with the heat roller 71. A discharge roller 8 is positioned downstream of the fixing unit 7 in the sheet feeding direction, and a discharge tray 9 is provided at an upper portion of the main casing 2.

The toner image formed on the sheet P is thermally fixed to the sheet P when the sheet P passes through a gap between the heat roller 71 and the pressure roller 72. The sheet P is then conveyed to the discharge tray 9 by the discharge roller 8.

[Detailed Structure of the Developing Cartridge]

Figure 3:
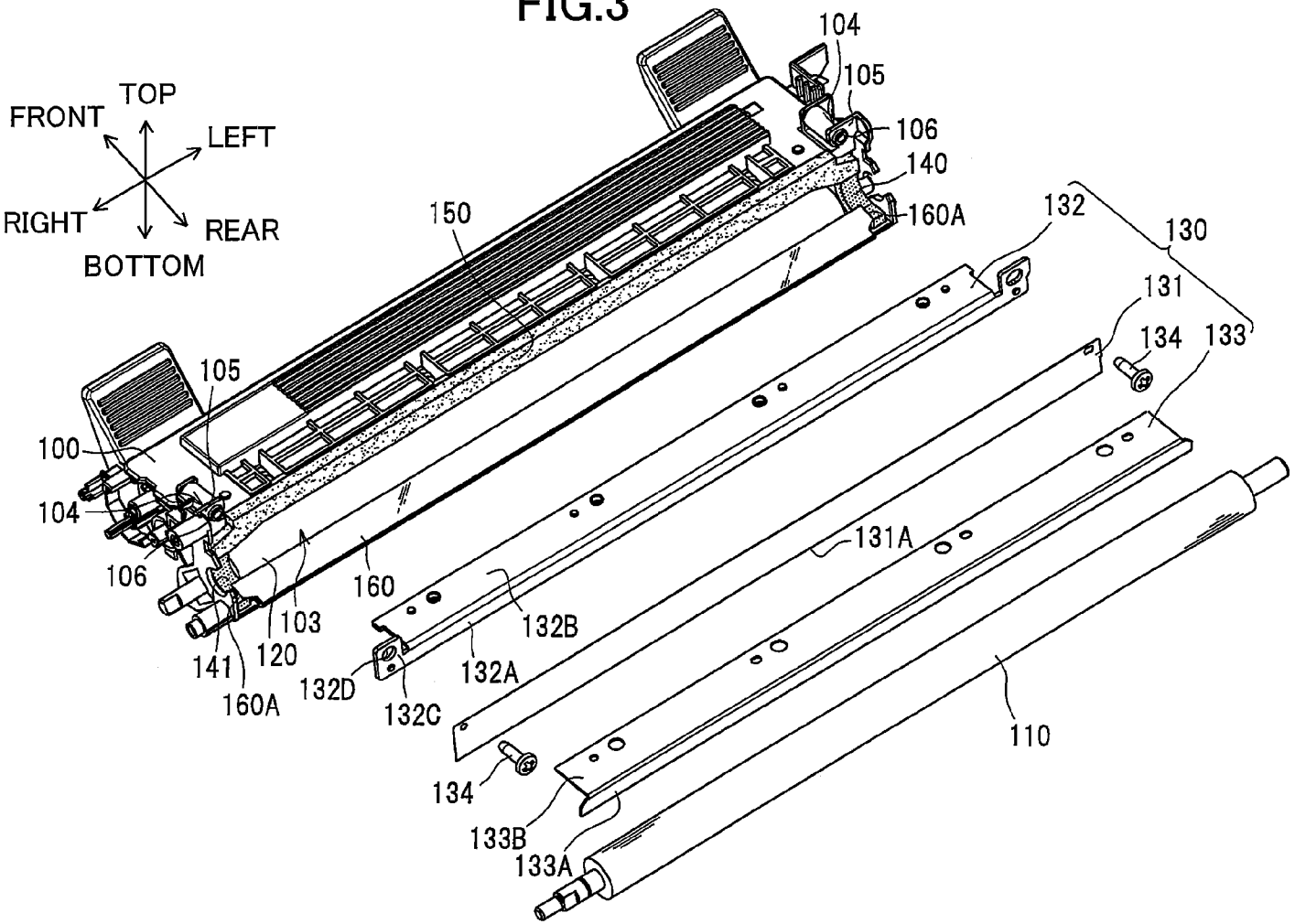
FIG. 3 is an exploded perspective view of the developing cartridge according to the embodiment.

Details of the frame 100 and the blade unit 130 of the developing cartridge 10 will be described. The developing cartridge 10 constitutes the process cartridge 5. As shown in FIG. 3, the frame 100 has a rear side wall formed with a rectangular opening 103, and the developing roller 110 and the blade unit 130 are attached to the frame 100 such that the developing roller 110 and the blade unit 130 close the opening 103. A first side seal member 140, a second side seal member 141, an upper seal member 150, and a film member 160 are provided around a rectangular perimeter of the opening 103 to prevent the toner in the frame 100 from being leaked out of the frame 100.

Figure 4:
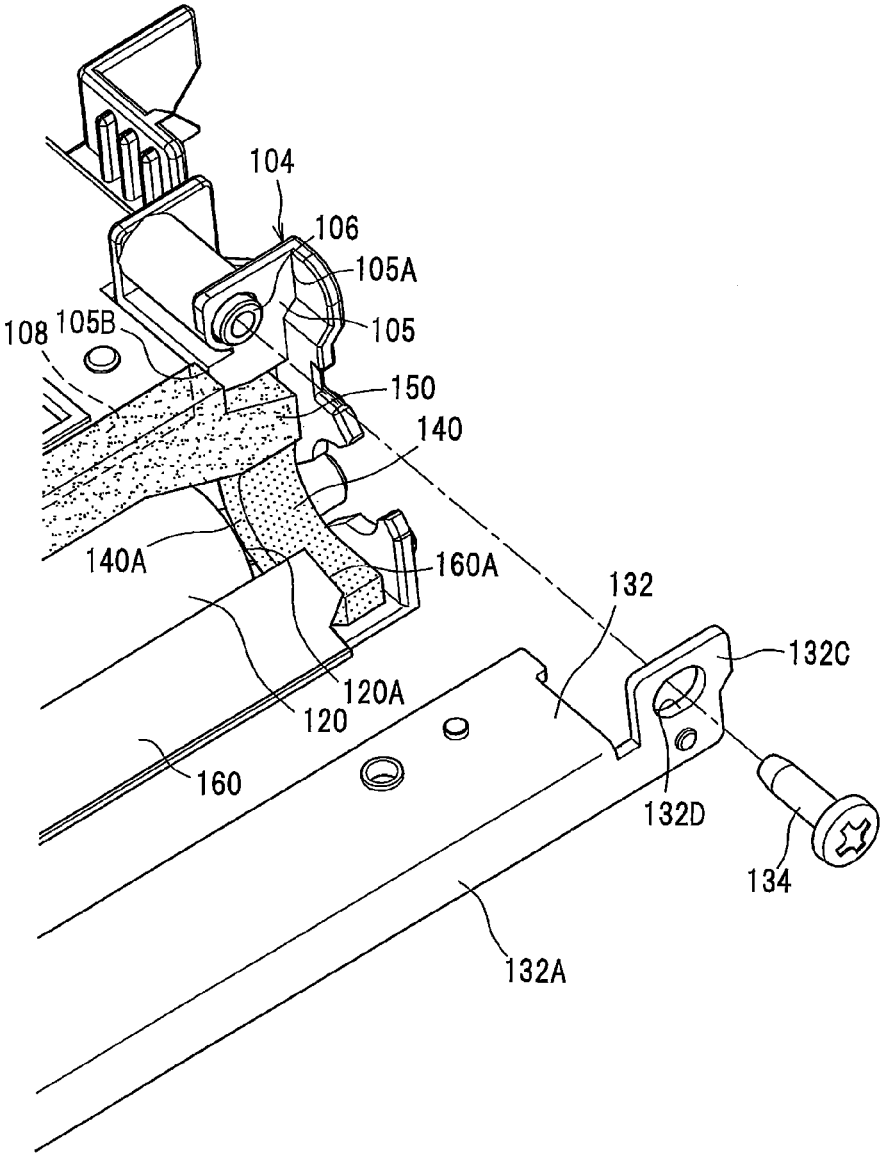
FIG. 4 is an enlarged partial perspective view of a left end portion of a cartridge frame in the developing cartridge according to the embodiment.

A fixing portion 104 is provided at each upper end portion of an upper edge of the opening 103 for fixing the blade unit 130. Each fixing portion 104 has a support surface 105 facing rearward. A boss 106 formed with a female thread hole is provided at the support surface 105. Further, an attachment surface 108 is provided at the upper edge portion of the opening 103 and at a position frontward of the fixing portion 104 in frontward/rearward direction of the frame 100 for fixing the upper seal member 150 to the attachment surface 108 as shown in FIG. 4. The attachment surface 108 faces rearward and extends in leftward/rightward direction of the frame 100 to a portion adjacent to and above a portion where the first and second side seal members 140, 141 is provided.

The blade unit 130 includes a blade body 131, a blade holder 132, and a reinforcing plate 133. The blade body 131 is formed of a metal plate such as a stainless steel plate, and has a free end portion functioning as a contact portion 131A. The free end portion of the contact portion 131A is bent or curved (see FIG. 2) and is in confrontation with and in contact with the peripheral surface of the developing roller 110. Because of this curved contact portion 131A, the blade body 131 regulates a thickness of the toner layer formed on the developing roller 110 into a uniform thickness.

The blade holder 132 includes a blade support section 132A for supporting the blade body 131, a reinforced section 132B to which the reinforcing plate 133 is attached, and a pair of attachment sections 132C to be attached to the pair of fixing portions 104 of the frame 100. The reinforced section 132B is bent frontward at substantially right angle with respect to the blade support section 132A from an upper edge thereof. Each attachment section 132C is provided at each longitudinal end portion of the blade holder 132 such that each attachment section 132C can be superposed with each support surface 105 of each fixing portion 104 in frontward/rearward direction. Each attachment section 132C protrudes upward from each longitudinal end portion of the blade support section 132A. The longitudinal end portion is an end portion of the blade support section 132A in rightward/leftward direction. Further, each attachment section 132C is formed with a through-hole 132D penetrating the same in frontward/rearward direction.

The reinforcing plate 133 includes a nip section 133A and a fixing section 133B. The nip section 133A is adapted to nip the blade body 131 in cooperation with the blade support section 132A of the blade holder 132. The fixing section 133B is adapted to be fixed to the reinforced section 132B of the blade holder 132. The nip section 133A is bent downward at substantially right angle with respect to the fixing section 133B from a rear edge thereof.

The blade body 131 is nipped between the blade support section 132A of the blade holder 132 and the nip section 133A of the reinforcing plate 133, and the reinforced section 132B of the blade holder 132 and the fixing section 133B of the reinforcing plate 133 are fixed together by threads (not shown), to thus provide an integral blade unit 130. As shown in FIG. 4, each thread 134 extends through each through-hole 132D of the attachment section 132C of the blade holder 132, and the thread 134 is threadingly engaged with each female thread of the boss 106 at the fixing portion 104. Thus, the blade unit 130 is fixed to the frame 100.

The first and second side seal members 140, 141 are adapted to perform sealing between the frame 100 and axial end portions of the developing roller 110. Each of the side seal members 140, 141 is arcuate in shape in conformance with an outer peripheral shape of the developing roller 110. Each of the side seal members 140, 141 includes a base layer attached to the frame 100 and a sliding layer formed on the base layer and in sliding contact with the peripheral surface of the developing roller 110. The base layer is formed of a sponge member made from urethane foam or a silicone sponge. The sliding layer is formed of a woven fabric for trapping the toner, and has a fluffed surface. PTFE (polytetrafluoroethylene) fiber, PET (polyethylene terephthalate) fiber, acrylic fiber, and nylon fiber are available as a material of the sliding layer.

The upper seal member 150 is adapted to perform sealing between the frame 100 and the blade unit 130 along a length of the blade unit 130 and is formed of a sponge member such as a silicon sponge or a urethane foam. The upper seal member 150 is adhesively bonded to the attachment surface 108 of the frame 100, such that the upper seal member 150 is nipped between the attachment surface 108 and the blade support section 132A of the blade holder 132.

The film 160 is formed of a resin material such as PET, acrylic resin and fluorine resin. The film 160 extends in the axial direction of the developing roller 110. The film 160 has a base end portion attached to eh frame 100, and a free end portion directing toward an internal space of the frame 100 and in sliding contact with the peripheral surface of the developing roller 110. The film 160 is positioned below the developing roller 110 and upstream of the blade unit 130 in the rotational direction of the developing roller 110.

[Details of Lateral End Portions of the Developing Cartridge]

Lateral end portions of the developing cartridge 10 are end portions thereof in rightward/leftward direction. Since the right end portion and left end portion of the developing cartridge 10 are symmetrical with each other, only the left end portion will be described.

Figure 5:
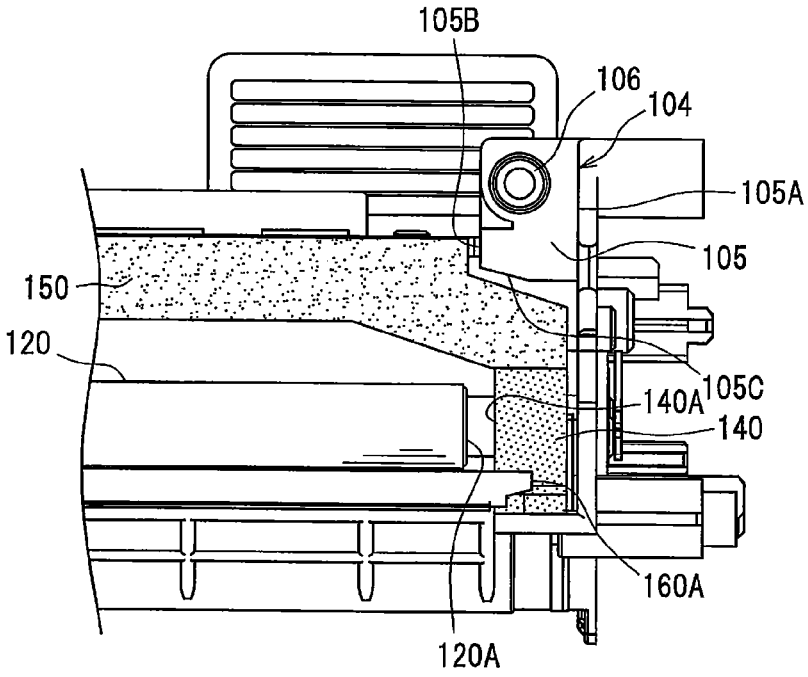
FIG. 5 is an enlarged partial rear view of the left end portion of the cartridge frame in the developing cartridge according to the embodiment.

As shown in FIGS. 3, 4 and 5, the support surface 105 of the fixing portion 104 extends in vertical direction and faces to the developing roller 110. Further, the support surface 105 extends approximately parallel to the attachment surface 108 of the frame 100. The boss 106 formed with the female thread hole protrudes rearward from the support surface 105. Further, the support surface 105 is positioned rearward of the attachment surface 108 in the frontward/rearward direction. That is, the support surface 105 is closer to the developing roller 110 than the attachment surface 108 to the developing roller 110 in frontward/rearward direction.

The support surface 105 of the frame 100 has an outer edge 105A and an inner edge 105B in the lateral direction of the frame 100 (in the longitudinal direction of the blade unit 130), and the first side seal member 140 has an inner edge 140A and an outer edge 140B in the lateral direction (in the axial direction of the developing roller 110). The outer edge 105A is positioned outward of the inner edge 140A in the lateral direction. Further, the inner edge 105B of the support surface 105 is positioned outside of an image forming region in the axial direction of the developing roller 110, and inward of the inner edge 140A of the first side seal member 140.

More specifically, the inner edge 105B of the support surface 105 is positioned between an axial end surface 120A of the supply roller 120 and the inner edge 140A of the first side seal member 140. Further, the inner edge 105B is positioned inward of a longitudinal end 160A of the film 160 in the longitudinal direction thereof.

Further, the support surface 105 has an inclined lower edge 105C connected to the inner edge 105B. The inclined lower edge 105C is inclined so as to gradually away from an edge of the contact portion 131A toward a longitudinal center of the blade unit 130.

[Positions of First and Second Side Seal Members]

Figure 6:
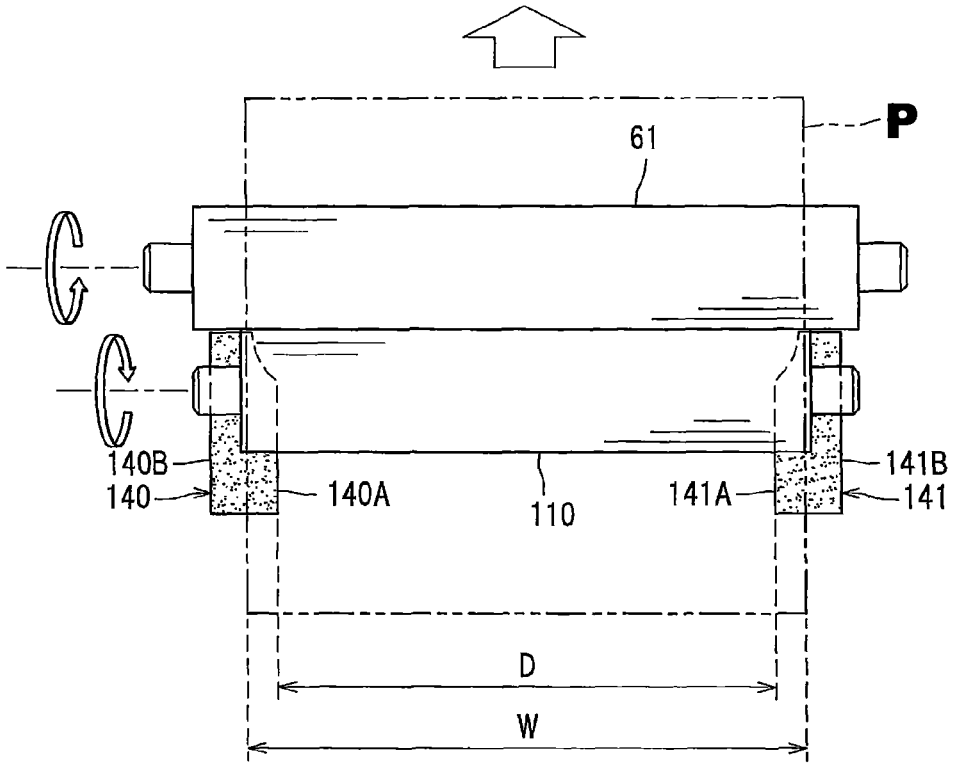
FIG. 6 is a schematic rear view showing positional relationship among a photosensitive drum, a developing roller, and seal members in the process cartridge according to the embodiment.
Figure 7:
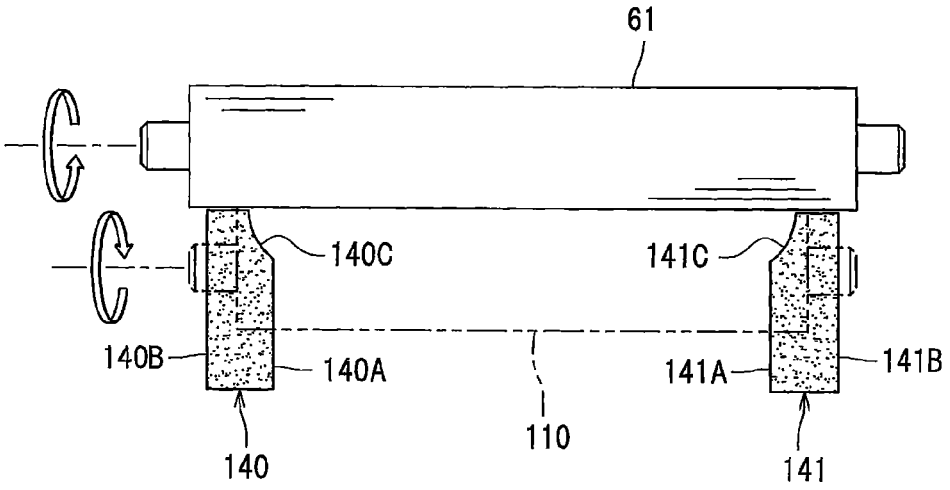
FIG. 7 is a schematic rear view particularly showing notched portions of the side seal members in the process cartridge according to the embodiment.

The first and second side seal members 140, 141 will be described in detail with reference to FIGS. 6 and 7. Incidentally, FIGS. 6 and 7 are schematic rear views as viewed from a rear side in FIG. 3. The first side seal member 140 that seals a boundary between the frame 100 and one axial end portion of the developing roller 110 is positioned at left side in FIGS. 5 and 7, and the second side seal member 141 that seals a boundary between the frame 100 and another axial end portion of the developing roller 110 is positioned at right side in FIGS. 5 and 7.

As shown in FIG. 6, one end portion of the developing roller 110 that is in rolling contact with the photosensitive drum 61 is in rolling contact with an inner surface of the first seal member 140, and another end portion of the developing roller 110 is in rolling contact with an inner surface of the second seal member 141. The developing roller 110 has one end face positioned between the inner edge 140A and the outer edge 140B of the first side seal member 140 in the axial direction of the developing roller 110, i.e., in a widthwise direction of the first side seal member 140. Similarly, the developing roller 110 has another end face positioned between an inner edge 141A and an outer edge 141B of the second side seal member 141 in the widthwise direction of the second side seal member 141.

A distance D between the inner edge 140A of the first side seal member 140 and the inner edge 141A of the second side seal member 141 is smaller than a width W in lateral direction of a maximum size sheet P such as A4 size sheet to be conveyed by the photosensitive drum 61. That is, widthwise edges of the maximum size sheet P in the widthwise direction is overlapped with the first side seal member 140 and the second side seal member 141, respectively. More specifically, the first side seal member 140 is positioned such that one widthwise edge of A4 sheet is positioned at a center portion between the inner edge 140A and the outer edge 140B. Similarly, the second side seal member 141 is positioned such that another widthwise edge of A4 sheet is positioned at a center portion between the inner edge 141A and the outer edge 141B.

Here, the sheet P is bilaterally symmetric with respect to a center in the axial direction of the developing roller 110 and the photosensitive drum 61. Further, the first and second side seal members 140, 141 are bilaterally symmetric with each other with respect to the center. More specifically, the first and second side seal members 140, 141 are plane symmetry with respect to an imaginary plane perpendicular to the center of the developing roller 110 in the axial direction and extending in a direction perpendicular to the axial direction. Further, in a state where the process cartridge 5 is accommodated in the main casing 2, a center of an image forming region of the photosensitive drum 61 in the axial direction thereof is on the imaginary plane. That is, the center of the image forming region of the photosensitive drum 61 in the lateral direction is coincident with the center of the developing roller 110 in the axial direction. Further, the sheet P is set and conveyed by the feeder unit 3 such that a widthwise center of the sheet P is positioned coincident with the imaginary plane.

Further, as shown in FIG. 7, the first and second side seal members 140, 141 have notched portions 140C, 141C, respectively for trapping paper dust thereat. The notched portion 140C is located at an upstream side of the first side seal member 140 in the rotating direction of the developing roller 110, and is notched in arcuate shape at the inner edge 140A. Similarly, the notched portion 141C is located at an upstream side of the second side seal member 141 in the rotating direction of the developing roller 110, and is notched in arcuate shape at the inner edge 141A. These notched portions 140C, 141C are shaped such that the each curvature is directed outward as the curvature approaches the upstream end in the rotational direction. As shown in FIG. 5, the longitudinal end 160A of the film 160 is overlapped with the first side seal member 140 in rightward/leftward direction, e.g., a portion adjacent to the notched portion 140C.

[Function]

In the developing cartridge 10 thus constructed, since the support surface 105 is positioned rearward of the attachment surface 108 to which the upper seal member 150 is attached, the upper seal member 150 can be nipped with a desirable compressed state between the blade support section 132A and the attachment surface 108 of the frame 10, and the blade support section 132A can be fixed to the support surface 105 with a sufficient contacting state therewith without any floating of the longitudinal end portion of the blade support section 132A.

Here, the inner edge 105B of the support surface 105 is positioned between the axial end 120A of the supply roller 120 and the inner edge 140A of the side seal member 140. In other words, the support surface 105 is positioned to superpose with inner edge 140A of the side seal member 140 that performs sealing between the frame 100 and the axial end portion of the developing roller 110 in the longitudinal direction of the blade unit 130. Therefore, the contact portion 131A of the blade body 131 can be in contact with the peripheral surface of the developing roller 110 with a sufficient contacting pressure at a position adjacent to the inner edge 140A of the side seal member 140. Consequently, sufficient triboelectric charging to the toner occurs at a position between the peripheral surface of the developing roller 110 and the contact portion 131A of the blade body 131, which can restrain toner leakage from a boundary between each axial end portion of the developing roller 110 and the blade body 131 of the blade unit 130.

Further, since the inner edge 105B of the support surface 105 is positioned outward of the axial end of the supply roller 120, toner can be sufficiently supplied from the supply roller 120 to the developing roller 110 even at the axial end portion 120A of the supply roller 120.

Further, the inclined lower edge 105C is inclined away from the contact portion 131A in a direction toward the longitudinal center of the blade unit 130. Therefore, at the axial end portions of the developing roller 110, contacting pressure of the contact portion 131A with respect to the peripheral surface of the developing roller 110 can be gradually reduced without abrupt change toward the longitudinal center of the blade unit 130. Consequently, toner leakage out of the boundary between the blade body 131 and the axial end portions of the developing roller 110 can be stably restrained.

[Collection of Paper Dust]

As shown in FIG. 6, in case of conveying the maximum width sheet, i.e., A4 size sheet P to the photosensitive drum 61, paper dust adhered onto one widthwise end portion of the sheet P is transferred onto the one peripheral end portion of the developing roller 110 through the peripheral surface of the photosensitive drum 61. The paper dust on the one peripheral end portion of the developing roller 110 is then trapped and collected by the first side seal member 140 in accordance with the rotation of the developing roller 110. In this case, major part of the paper dust is trapped at a surface of the notched portion 140C, i.e., within the thickness of the notched portion 140C of the first side seal member 140.

Similarly, paper dust adhered onto the other widthwise end portion of the sheet P is transferred onto the other peripheral end portion of the developing roller 110 through the peripheral surface of the photosensitive drum 61. The paper dust on the other peripheral end portion of the developing roller 110 is then trapped and collected by the second side seal member 141 in accordance with the rotation of the developing roller 110. In this case, major part of the paper dust is trapped at a surface of the notched portion 141C, i.e., within the thickness of the notched portion 141C of the second side seal member 141.

Since the notched portion 140C is formed at the upstream side of the first side seal member 140, a pressure exerted on the first side seal member 140 by the developing roller 110 is reduced around the notched portion 140C and thus the paper dust on the other peripheral end portion of the developing roller 110 is trapped and collected by the first side seal member 140. Similarly, since the notched portion 141C is formed at the upstream side of the second side seal member 141, a pressure exerted on the second side seal member 141 by the developing roller 110 is reduced around the notched portion 141C and thus the paper dust on the other peripheral end portion of the developing roller 110 is trapped and collected by the second side seal member 141.

As described above, according to the cartridge of the above-described embodiment, in case of conveying the maximum width sheet, i.e., A4 size sheet P to the photosensitive drum 61, paper dust adhered onto each widthwise end portion of the sheet P can be trapped by each of the first and second side seal members 140, 141. Therefore, mixing of the paper dust into the toner contained in the frame 100 can be restrained or avoided.

Various modifications are conceivable. For example, each widthwise edge of a maximum width sheet can be positioned outward of the first side seal member and the second side seal member in the widthwise direction of the sheet. Further, the cartridge according to the present invention can be applied not only to the monochromatic printer shown in FIG. 1, but also to a color printer, a copying machine, and a multi-function device. The frame 100 of the developing cartridge 10 accommodates therein the toner. The developing cartridge may detachably receive a toner cartridge for accommodating toner therein.

While the invention has been described in detail with reference to the above-described embodiments thereof, it would be apparent to those skilled in the art that various changes and modifications may be made therein without departing from the spirit of the invention.

What is claimed is:

1. A cartridge for supplying developing agent to a peripheral surface of a photosensitive drum comprising:

a frame;

a developing roller rotatable about an axis that defines an axial direction, and configured to supply developing agent in the frame to the photosensitive drum, the developing roller having one end portion and another end portion in the axial direction;

a first side seal member configured to seal a boundary between the frame and the one end portion of the developing roller; and a second side seal member configured to seal a boundary between the frame and the another end portion of the developing roller, the first side seal member and the second side seal member defining a gap therebetween in the axial direction, and the gap having a gap length smaller than a width in the axial direction of a maximum width sheet conveyed to the photosensitive drum, wherein the first side seal member is positioned such that one widthwise edge of the maximum width sheet in the axial direction is positioned at a center portion of the first side seal member in the axial direction, and the second side seal member is positioned such that another widthwise edge of the maximum width sheet in the axial direction is positioned at a center portion of the second side seal member in the axial direction.

2. The cartridge as claimed in claim 1, wherein the first side seal member and the second side seal member have inner edges in the axial direction, and have upstream end portions in a rotational direction of the developing roller, the inner edges being formed with notched portions configured to trap paper dust, the notched portions being formed at the upstream end portions of the first side seal member and the second side seal member, respectively.

3. The cartridge as claimed in claim 2, wherein the notched portions are notched in arcuate shape, the notched portions having a curvature directed outward as the curvature approaches the upstream end portions of the first side seal member and the second side seal member.

4. The cartridge as claimed in claim 1, wherein the developing roller has a peripheral surface;

wherein the cartridge further comprises an elongated blade unit in contact with the peripheral surface and configured to regulate a thickness of a layer of the developing agent supplied to the peripheral surface, the blade unit having longitudinal end portions;

wherein the frame includes support surfaces to which the longitudinal end portions are fixed, the support surfaces facing the developing roller, and having inner edges in the axial direction; and wherein the first side seal member and the second side seal member have inner edges in the axial direction, the inner edges of the support surfaces being positioned inward of the inner edges of the first side seal member and the second side seal member.

5. A cartridge for supplying developing agent to a peripheral surface of a photosensitive drum comprising:

a frame;

a developing roller rotatable about an axis that defines an axial direction, and configured to supply developing agent in the frame to the photosensitive drum, the developing roller having one end portion and another end portion in the axial direction and a peripheral surface;

a first side seal member configured to seal a boundary between the frame and the one end portion of the developing roller;

a second side seal member configured to seal a boundary between the frame and the another end portion of the developing roller, the first side seal member and the second side seal member defining a gap therebetween in the axial direction, and the gap having a gap length smaller than a width in the axial direction of a maximum width sheet conveyed to the photosensitive drum; and an elongated blade unit in contact with the peripheral surface and configured to regulate a thickness of a layer of the developing agent supplied to the peripheral surface, the blade unit having longitudinal end portions, wherein the frame includes support surfaces to which the longitudinal end portions are fixed, the support surfaces facing the developing roller, and having inner edges in the axial direction; and wherein the first side seal member and the second side seal member have inner edges in the axial direction, the inner edges of the support surfaces being positioned inward of the inner edges of the first side seal member and the second side seal member.

6. The cartridge as claimed in claim 5, wherein the first side seal member and the second side seal member have inner edges in the axial direction, and have upstream end portions in a rotational direction of the developing roller, the inner edges being formed with notched portions configured to trap paper dust, the notched portions being formed at the upstream end portions of the first side seal member and the second side seal member, respectively.

7. The cartridge as claimed in claim 6, wherein the notched portions are notched in arcuate shape, the notched portions having a curvature directed outward as the curvature approaches the upstream end portions of the first side seal member and the second side seal member.

8. The cartridge as claimed in claim 5, wherein the first side seal member is positioned such that one widthwise edge of the maximum width sheet in the axial direction is positioned at a center portion of the first side seal member in the axial direction, and the second side seal member is positioned such that another widthwise edge of the maximum width sheet in the axial direction is positioned at a center portion of the second side seal member in the axial direction.

* * * * *